US008453957B2

(12) United States Patent
Zollinger

(10) Patent No.: US 8,453,957 B2
(45) Date of Patent: Jun. 4, 2013

(54) YARN PACKAGE HALTER

(76) Inventor: Richard V. Zollinger, Spartanburg, SC (US)

( * ) Notice: Subject to any disclaimer, the term of this patent is extended or adjusted under 35 U.S.C. 154(b) by 211 days.

(21) Appl. No.: 12/976,094

(22) Filed: Dec. 22, 2010

(65) Prior Publication Data

US 2012/0160949 A1 Jun. 28, 2012

(51) Int. Cl.
*B65H 59/16* (2006.01)

(52) U.S. Cl.
USPC ..... 242/156.1; 242/419; 242/422.1; 242/422.7

(58) Field of Classification Search
USPC ..... 242/147 R, 149, 129.8, 131, 131.1, 242/156.1, 172, 419, 419.4, 422.1, 422.4, 242/422.5, 422.6, 422.7, 422.8, 423, 423.1, 242/566, 615, 615.3
See application file for complete search history.

(56) References Cited

U.S. PATENT DOCUMENTS

| | | | | |
|---|---|---|---|---|
| 2,869,802 | A | | 1/1959 | Williams |
| 2,909,913 | A | | 10/1959 | Strub, Jr. |
| 2,953,318 | A | * | 9/1960 | Hasler et al. ..... 242/128 |
| 3,043,537 | A | | 7/1962 | Chapman et al. |
| 3,307,805 | A | | 3/1967 | Verbeek |
| 3,632,062 | A | | 1/1972 | Sole |
| 3,990,652 | A | | 11/1976 | Brown |
| 6,237,866 | B1 | | 5/2001 | Nagayama |

* cited by examiner

*Primary Examiner* — William E Dondero
(74) *Attorney, Agent, or Firm* — Thomas L. Moses; Southeast IP Group, LLC

(57) ABSTRACT

A yarn package halter comprises a frame for supporting a series of contact members that are used to maintain slight contact with the base or back portion of a yarn package during an unwinding operation as part of a textile manufacturing process. In a preferred embodiment, the contact members are elastic cords, which serve to hold the yarn package together in order to prevent the yarn package from unraveling, which can lead to entanglements and other processing problems. The frame member is structured so that the contact members form a cone shape or a partial cone shape, and this arrangement allows the contact members to maintain slight contact throughout the manufacturing process, even as the size of the yarn package is reduced during the unwinding operation.

9 Claims, 6 Drawing Sheets

YARN PACKAGE HALTER

BACKGROUND OF THE INVENTION

The present invention relates to devices used to hold and maintain the structure of yarn packages during textile manufacturing processes. More specifically, the present invention includes an apparatus used to hold a yarn package in place while preventing the yarn from becoming unraveled or entangled as the yarn is being unwound for a textile manufacturing process.

One problem associated with textile manufacturing is that the yarn, as it is being fed into textile machinery such as a loom, loses tension or slackens occasionally, and becomes partially unraveled from the package. When such unraveling occurs, it is not uncommon for the yarn to catch, either by hanging up on the rear portion of the yarn package itself, or by hanging up on the creel, mandrel or another component of the textile machinery, often causing the yarn to break. When an industrial loom is running, and running yarns that are fed from hundreds of yarn packages, this unraveling problem must be addressed by halting the entire operation and reattaching (or tying) the broken strand of yarn back together.

Heretofore, other devices have been employed to hold yarn packages in place and prevent it from unraveling. U.S. Pat. No. 3,623,062 is directed to a thread-tensioning and balloon control for unwinding yarn from packages on textile machines, and includes a circular, supporting, rim-like means that is positioned about the package unwinding end. It is provided internally with a plurality of pivoted, spring loaded tensioning members spaced circumferentially around the supporting rim to inhibit the ballooning tendencies of the yarn being drawn from the package.

Similarly, U.S. Pat. No. 2,909,913 discloses a device for controlling the wildness of yarn during delivery to a web forming machine, wherein the device comprises a frame that includes a couple of collars attached to support members. The collars are adjustable along the supports, and have a knitted tube disposed between the collars. The device is secured around the yarn package and adjusted so that the knitted tube comes into slight contact with the yarn package as the yarn is being delivered from the package.

U.S. Pat. No. 6,237,866 is directed to a yarn unwinding tension stabilizer, which includes a circular frame having a series of elastic wiring materials concavely curved towards the center and overlapping one another. The frame is placed about a yarn package, and the wiring materials come into contact with the yarn surface in order to stabilize and provide tension to the yarn. All of the references cited above are incorporated herein by reference.

However, there are problems associated with these and other devices that purport to stabilize yarn on a package during yarn delivery. First, the devices must be put into place after the yarn package has been placed onto the shaft, which takes time and effort, especially when the creel supports hundreds of yarn packages. Secondly, the devices tend to be complex, rather than simple, and repairs may be expensive and time consuming. Thirdly, the devices inhibit easy access to the yarn packages while the devices are in operational position. Additionally, it is difficult, if not impossible, to use these prior devices in conjunction with reserve yarn packages that are tied to the primary yarn package in order to keep the yarn feed moving even when the primary yarn package is exhausted.

Thus, it would be desirable to provide an apparatus that would stabilize yarn during the delivery process from a yarn package, wherein the apparatus is simple, inexpensive to manufacture and easy to maintain. Additionally, it would be desirable to provide such an apparatus that allows for easy access to the yarn package while the apparatus and yarn package are in operational position. Further, it would be advantageous to provide such a device that could be mounted on a creel one time, and does not have to be removed or repositioned every time a new package of yarn is placed on a creel.

BRIEF SUMMARY OF THE INVENTION

In accordance with one aspect of the invention, a yarn package halter comprises a frame, including a V-shaped support member having a pair of arms, wherein the outer portions of the arms extend transversely away from the plane of the V in roughly a 90° angle. A large semi-circular member is attached to the outer portions of the arms. In one embodiment, a small semi-circular member is attached to the frame adjacent the apex of the V-shape (i.e. at or near the point of the V). Both the large and the small semi-circular members define an equal number of holes, and a series of contact members, preferably elastic cords, extend between corresponding holes of the small semi-circular member and the large semi-circular member. Essentially, the contact members are disposed in the shape of a partial cone shape, supported by the frame. In a second embodiment, the small semi-circular member is not attached directly to the frame, but is free to move with respect to the frame and is simply supported by the contact members. These arrangements allow a variety of yarn packages having different sizes and weights to be used in a textile manufacturing process as the contact members are positioned to maintain contact with the running edge portions of the yarn package in order to maintain the structural integrity of the package.

In use, the frame is attached to a creel on a shaft that holds the yarn package using any suitable attachment method. When the yarn package is placed onto the shaft, the contact members come into contact with the running edge portion of the yarn package on the opposite side from the yarn feeding direction. As used herein, the term running edge is defined as the back edge of the yarn package, where the curved side of the package conjoins with the flat, round base of the package. As the yarn is delivered from the package, the contact members stabilize and maintain the yarn in place within the yarn package, thereby preventing slack yarn from falling off the rear portion of the package and creating entanglements or other problems. As the yarn package grows smaller throughout the delivery of the yarn, the contact members maintain contact with the running edge of the yarn package, thereby providing continuous support and stabilization of the yarn package.

In a third embodiment, the yarn package halter is formed into a circular shape, rather than a semi-circular shape. In this embodiment, the frame supports a large circular support member and a small circular support member with contact members running therebetween, so that the contact members form the shape of a cone or funnel. This circular embodiment is most useful for yarn packages oriented so that the axis of the package (and thus the shaft holding the yarn package) is vertically disposed. This arrangement allows the yarn package to be placed onto the shaft vertically so that the base of the yarn package is in contact with the contact members, and the yarn is fed from the package in an upward direction on an opposed end from the yarn package halter.

BRIEF DESCRIPTION OF THE DRAWINGS

These and other features, aspects, and advantages of the present invention will become better understood with regard to the following description, appended claims, and accompanying drawings where:

DETAILED DESCRIPTION OF THE INVENTION

Figure 1:
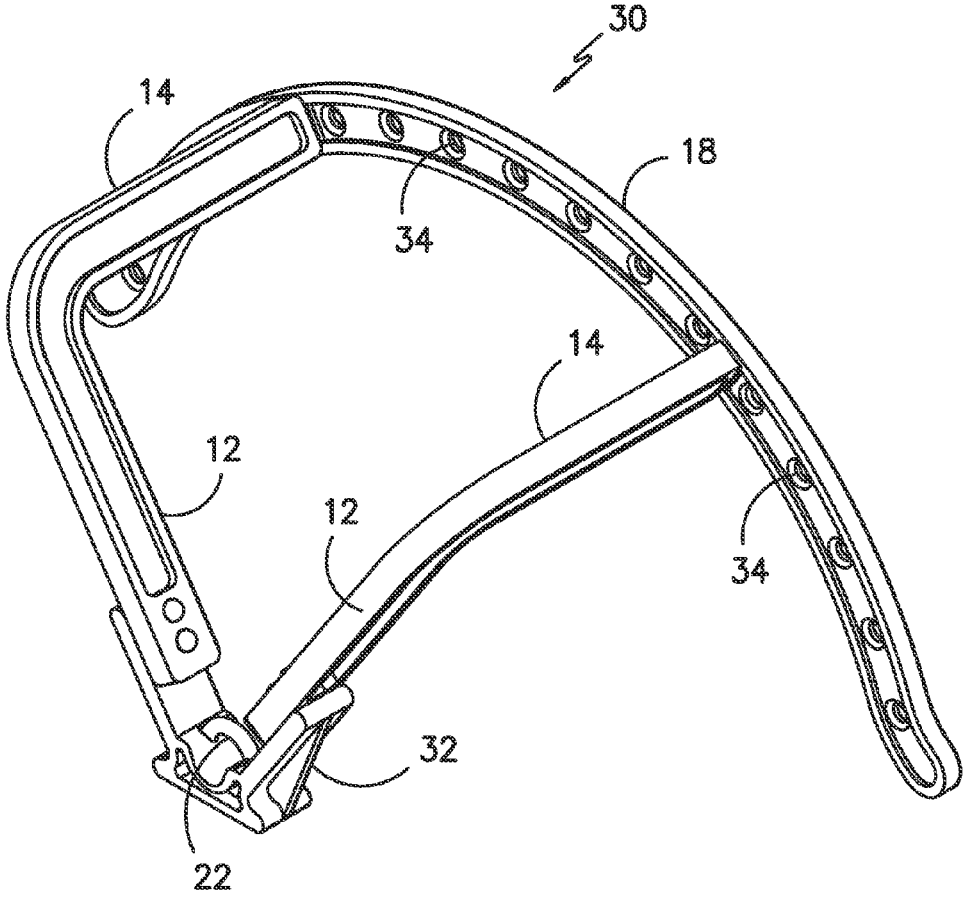
FIG. 1 is a perspective view of a yarn package halter frame in accordance with one aspect of the present invention.
Figure 2:
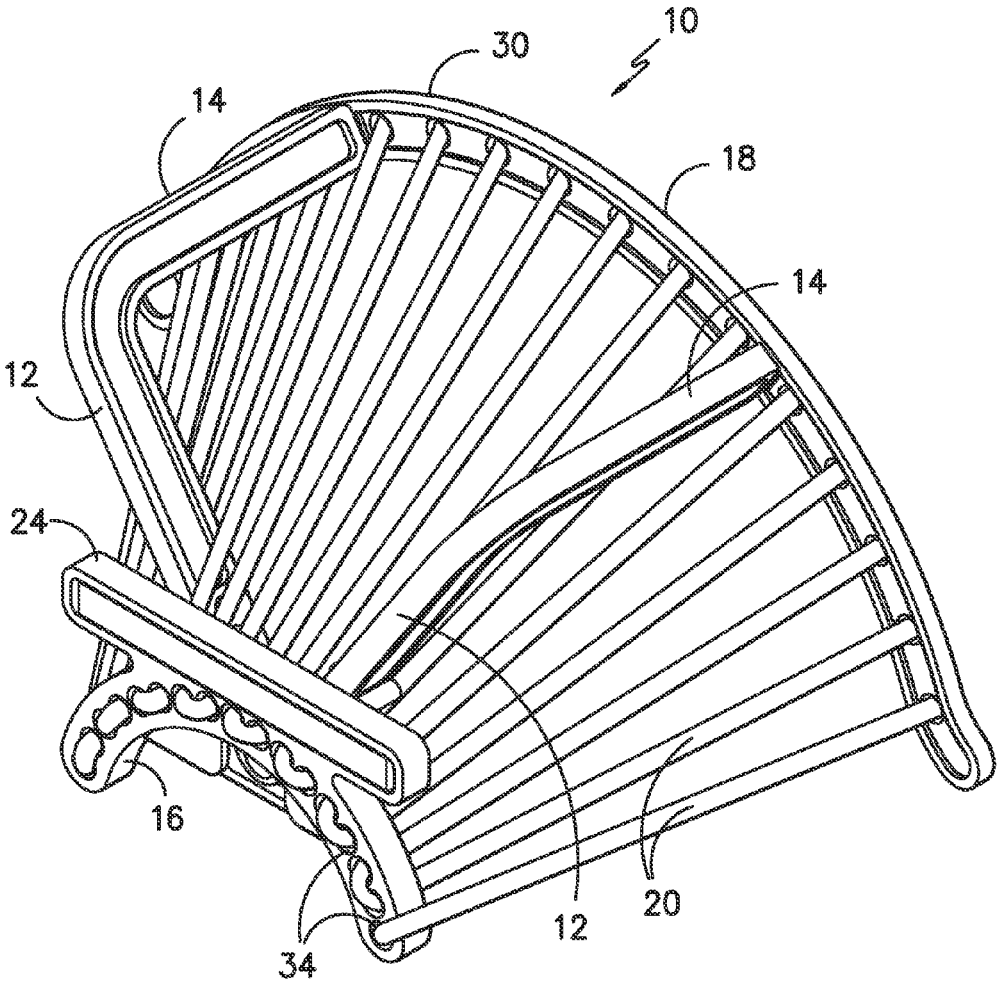
FIG. 2 is a perspective view of a yarn package halter in accordance with one aspect of the present invention.
Figure 3:
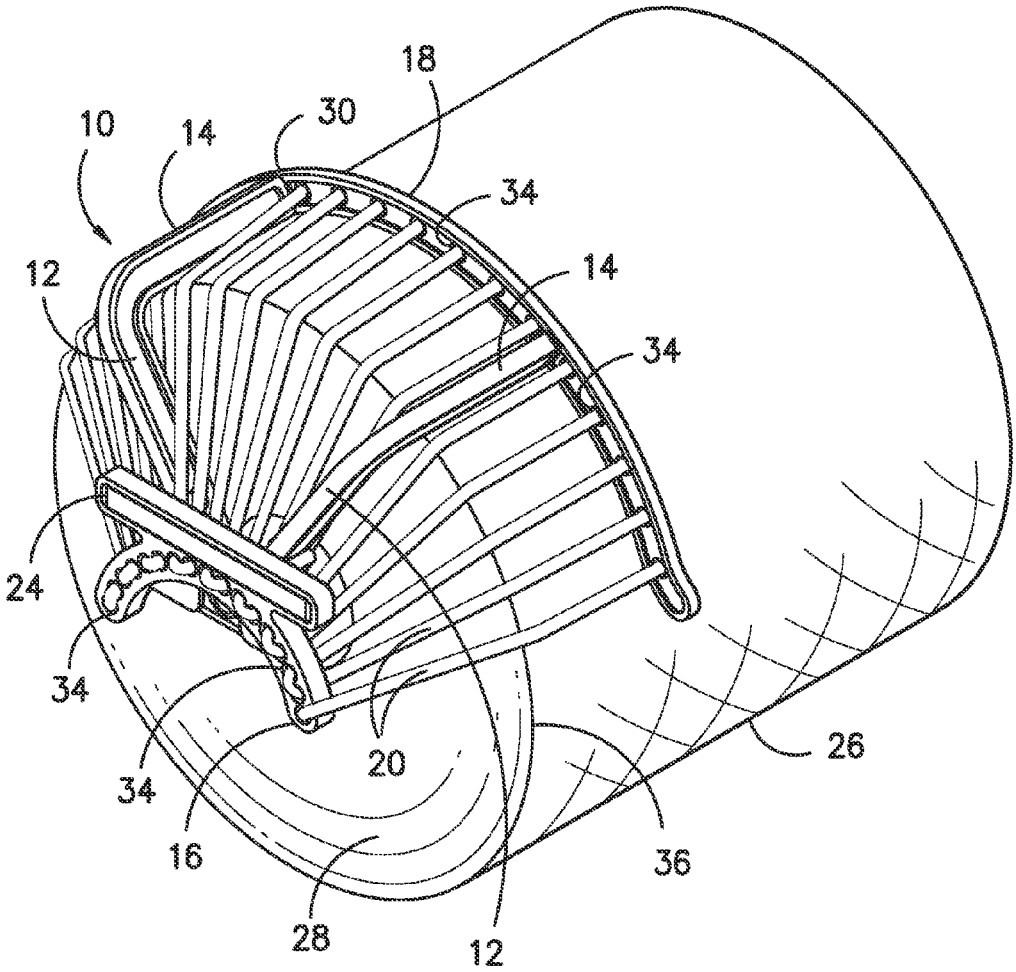
FIG. 3 is a side view of a yarn package positioned on a creel with a yarn package halter in operational position.
Figure 4:
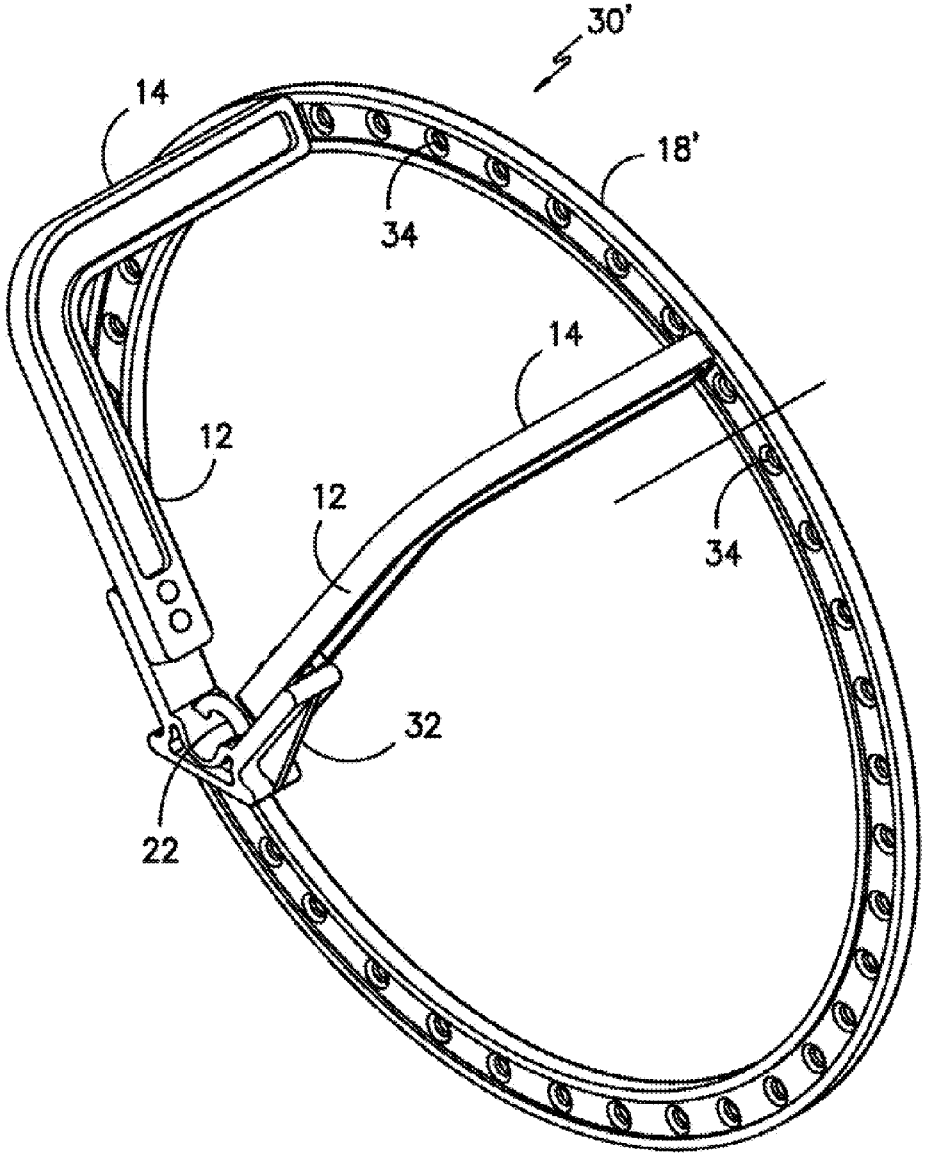
FIG. 4 is a perspective view of a yarn package halter frame in accordance with another aspect of the present invention.
Figure 5:
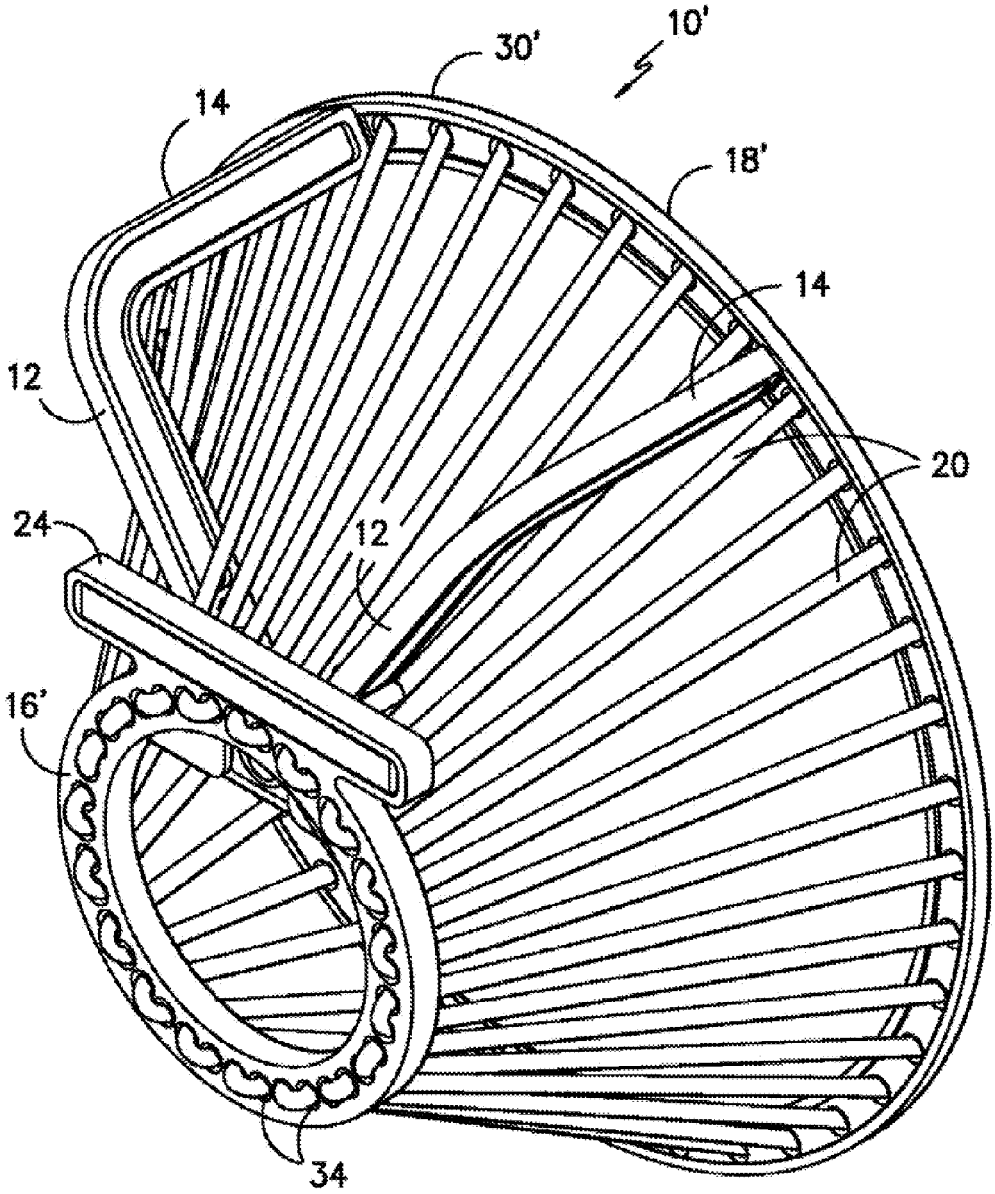
FIG. 5 is a perspective view of a yarn package halter in accordance with another aspect of the present invention.
Figure 6:
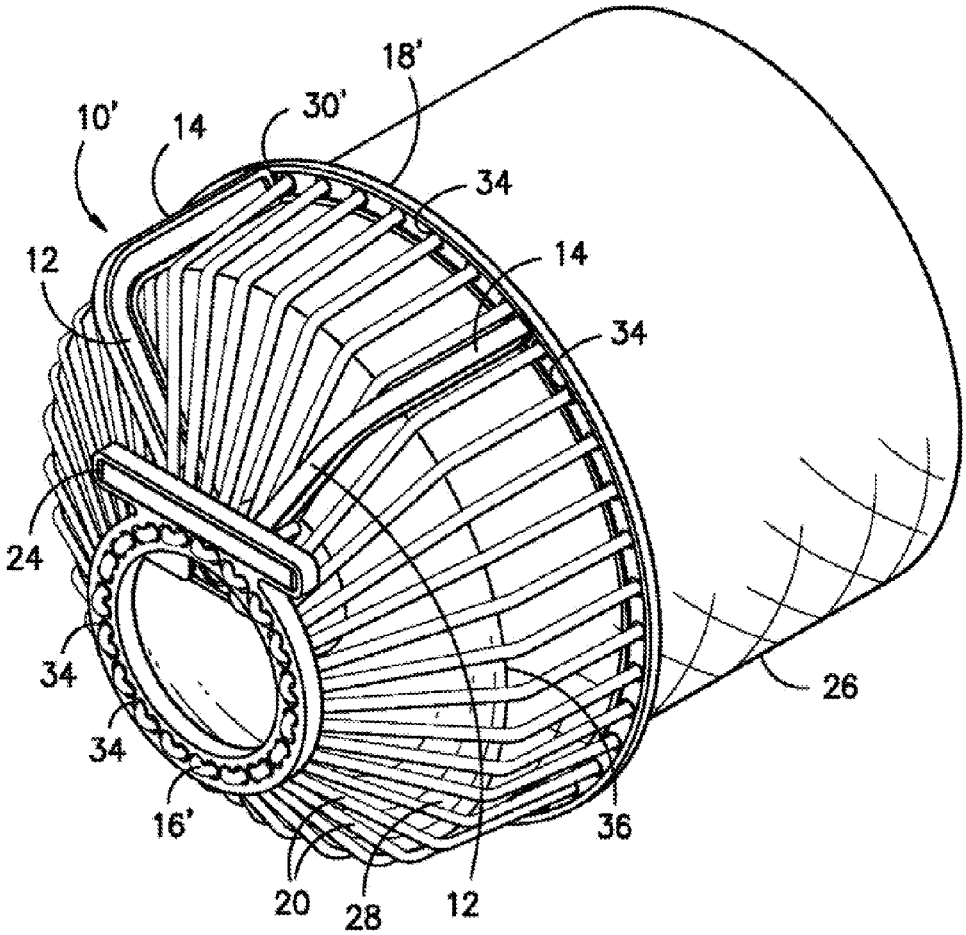
FIG. 6 is a side view of a yarn package positioned on a creel with a yarn package halter in operational position.

A first embodiment of a yarn package halter 10 is shown in FIGS. 1-3. Essentially, the yarn package halter 10 comprises a frame 30 for supporting a series of contact members 20 that are used to maintain slight contact with the base or back portion 28 of a yarn package 26 during an unwinding operation as part of a textile manufacturing process. In a preferred embodiment, the contact members 20 are elastic cords, which serve to hold the yarn package 26 together in order to prevent the yarn package 26 from unraveling, which can lead to entanglements and other processing problems. The frame member 30, in a first embodiment, is structured so that the contact members 20 form a partial cone shape.

The frame 30 comprises a V-shaped support member 32, and a pair of arms 12 attached to the V-shaped support member 32 wherein the outer portions 14 of the arms 12 extend transversely away from the plane of the V in roughly a 90° angle, as shown in FIG. 1. A large semi-circular member 18 is attached to the outer portions 14 of the arms 12. In one embodiment, a small semi-circular member 16 is attached to the frame adjacent the V-shaped support member 32 (i.e. at or near the point of the V). Both the large semi-circular member 18 and the small semi-circular member 16 define an equal number of holes 34, and a series of contact members 20, preferably elastic cords, extend between corresponding holes 34 between the small semi-circular member 16 and the large semi-circular member 18, as shown in FIG. 2. In a preferred embodiment, both the large 18 and small semi-circular members 16 are formed roughly in a shape between about a third (⅓) of a circle and a half (½) of a circle, although other fractions may be used. It is also contemplated that a small circular member may be used in place of the small semi-circular member, and that a large circular member may be used in place of the large semi-circular member, so that the contact members form a cone shape, as described below.

In FIG. 3, the frame 30 is mounted onto a shaft (not shown) that supports a yarn package via a U-bolt 22, or any other suitable attachment method, so that when the yarn package 26 is placed onto the shaft, the back portion or base 28 of the yarn package 26 comes into slight contact with the contact members 20. In a preferred embodiment, the contact members 20 are formed from elastic cords, which are slightly stretched to deform about the running edge 36 at the base 28 of the yarn package 26. These contact members 20 maintain contact with the running edge 36 of the yarn package 26 throughout the yarn delivery process, and as the yarn package becomes 26 smaller, the contact members 20 remain in contact with the running edge 36 of the yarn package 26 in order to maintain the integrity of the package, thereby reducing or eliminating entanglements or hang-ups due to slack yarn. Although the contact members 20 are preferably made from elastic cords, it is contemplated that the contact members 20 may be made from other materials, including string, monofilament, or may be formed from stiffer materials, including plastic or metal rods attached using any suitable method.

In a second embodiment, the small semi-circular member 16 is not attached directly to the frame 30, but is free to move with respect to the frame 30 on an opposed side from the large semi-circular member 18, and is simply supported by the contact members 20. This arrangement, especially when used in conjunction with elastic cords for the contact members 20, allows the contact members 20 to maintain slight contact with the running edge of the yarn package 26 without applying excessive force, which could be problematic during the manufacturing process. When a new yarn package 26 is placed on the shaft and comes into contact with the contact members 20, the smaller semi-circular member 16 may freely slide outwardly along the V-shaped support member 32 and arms 12, in a direction away from the apex of the V, in order to accommodate the size of the package. Then, as the yarn package 26 becomes smaller due to the yarn feeding process, the semi-circular member 16 slowly slides back toward the apex of the V, thus allowing a consistently slight contact between the contact members 20 and the yarn package 26 to be maintained. In order to maintain such slight contact and slightly increase tension between the contact members and the yarn package, a weight 24 may be attached or monolithically formed onto the small semi-circular member 16 (as shown in FIGS. 2 and 3), so that a slight downward gravitational force is provided thereto. The size of the weight may be increased or decreased, as desired.

Advantageously, once the yarn package halter 10 is mounted on the creel, it need not be adjusted or removed every time a new yarn package 26 is placed onto the shaft. Additionally, the partial cone shape of the frame 30 and contact members 20 allows a technician to have easy, unimpeded access to the yarn package throughout the manufacturing process. The frame 30 may be manufactured from any suitable material, including plastic or metal, and is preferably manufactured using an injection molding process. Additionally, the frame member 30 may be made from component parts, as shown, or may be manufactured monolithically. It is also contemplated that the V-shaped support member, the arms, and the large semi-circular member may be manufactured as a single component, and the small semi-circular member may be manufactured as a separate component. The present apparatus may be manufactured inexpensively, and is easy to fix and maintain. If one of the contact members 20 breaks or becomes worn after extensive use, it may be quickly and easily removed and replaced with another. When elastic cords are used as contact members 20, replacement simply requires threading a new elastic cord through the holes where the old cord was removed, and tying a knot in either end on the outside portion of the hole.

One advantage to this arrangement is that the present device may be used in conjunction with reserve yarn packages, as well as primary yarn packages. Oftentimes, a creel may hold a number of primary yarn packages, which feed directly into a textile manufacturing machine, and a number of secondary or reserve yarn packages. While one end of the primary yarn package feeds into the textile machinery, the opposed end, commonly called a "pigtail," may be tied or otherwise connected to the feeding end of a reserve yarn package, so that when the primary yarn package is exhausted, the yarn then automatically begins feeding from the reserve yarn package. This arrangement allows the yarn to continuously feed into the textile manufacturing process (or other process, such as twisting, knitting, weaving, etc.) without having to stop the machinery in order to replace an exhausted yarn package with a new, unused one. Because other, prior devices must be positioned around the outside of a yarn package after the yarn has been placed on the creel, such prior devices do not allow the pigtail of a primary yarn package to be seamlessly tied to a reserve package. In those cases, it is necessary to stop the textile machinery when each yarn package is exhausted, remove the tensioning device, remove the exhausted yarn package, replace that with a new yarn package, and re-install the tensioning device. This process is time consuming, labor intensive, and thus expensive, and the present device efficiently addresses that problem.

In yet another embodiment, the frame 30' of the yarn package halter 10' is formed into a circular shape, which is particularly useful for yarn packages where the axis of the yarn package is oriented vertically. In this embodiment, the frame defines a large circular member 18' and a small circular member 16' with contact members extending therebetween. The contact members, in this embodiment, form the shape of a cone or funnel, and maintain constant contact with the back portion of the yarn package throughout the unwinding process. Similarly to the yarn package halter having the semi-circular members, in this embodiment, the small circular member may either be attached directly to the frame, or it may be free to move with respect to the frame and is attached to the large circular member via the contact members. Functionally, this embodiment of the yarn package halter works in the same basic manner as the semi-circular embodiments.

Although the present invention has been described in considerable detail with reference to certain preferred versions thereof, other versions are possible. Therefore, the spirit and scope of the appended claims should not be limited to the description of the preferred versions contained herein. All features disclosed in this specification may be replaced by alternative features serving the same, equivalent or similar purpose, unless expressly stated otherwise. Thus, unless expressly stated otherwise, each feature disclosed is one example only of a generic series of equivalent or similar features.

What is claimed is:

1. A yarn package halter comprising:

a frame adapted to be mounted adjacent to a shaft member of a creel, wherein said shaft member serves as a support for a yarn package;

said frame comprising a V-shaped support member having a pair of arms, wherein outer portions of said arms extend transversely away from a plane of said V-shape in roughly a 90° angle;

a large semi-circular member attached to said outer portions of said arms;

a small semi-circular member disposed adjacent an apex of said V-shaped support member contact members attached to said frame, wherein said contact members extend between said large semi-circular member and said small semi-circular member; and wherein said contact members are positioned to maintain contact with said yarn package during an unwinding operation in order to stabilize said yarn package and prevent slack yarn from becoming entangled or broken during a textile manufacturing process.

2. The yarn package halter set forth in claim 1, wherein said contact members are formed from elastic cords.

3. The yarn package halter set forth in claim 1, wherein said small semi-circular member and said large semi-circular member define a series of holes, and wherein said contact members are attached through said holes.

4. The yarn package halter set forth in claim 1, wherein said small semi-circular member is attached to said frame.

5. The yarn package halter set forth in claim 1, wherein said small semi-circular member is attached to said contact members, and is free to move with respect to said frame.

6. A yarn package halter comprising:

a frame adapted to be mounted adjacent to a shaft member of a creel, wherein said shaft member serves as a support for a yarn package;

wherein said frame comprises a V-shaped support member having a pair of arms, wherein outer portions of said arms extend transversely away from a plane of said V-shape in roughly a 90° angle;

a large circular member attached to said outer portions of said arms;

a small circular member disposed adjacent an apex of said V-shaped support member;

wherein said contact members extend between said large circular member and said small circular member; and wherein said contact members are positioned to maintain contact with said yarn package during an unwinding operation in order to stabilize said yarn package and prevent slack yarn from becoming entangled or broken during a textile manufacturing process.

7. The yarn package halter set forth in claim 6, wherein said small circular member and said large circular member define a series of holes, and wherein said contact members are attached through said holes.

8. The yarn package halter set forth in claim 6, wherein said small circular member is attached to said frame.

9. The yarn package halter set forth in claim 6, wherein said small circular member is attached to said contact members, and is free to move with respect to said frame.

* * * * *